US006036042A

United States Patent [19]

Pietruch et al.

[11] Patent Number: 6,036,042

[45] Date of Patent: Mar. 14, 2000

[54] SEALED METAL CONTAINER

[75] Inventors: Walter P. Pietruch, Belvidere; Glenn S. Ceckowski, Rockford, both of Ill.

[73] Assignee: J. L. Clark, Rockford, Ill.

[21] Appl. No.: 09/128,232

[22] Filed: Aug. 3, 1998

[51] Int. Cl.[7] ..... B65D 25/00; B65D 25/14

[52] U.S. Cl. ..... 220/62.12; 220/62.22; 220/62.11; 53/411

[58] Field of Search ..... 220/62.22, 62.11, 220/62.12, 619; 53/411

[56] References Cited

U.S. PATENT DOCUMENTS

| | | | |
|---|---|---|---|
| 226,347 | 4/1880 | Pecor et al. | 220/62.12 |
| 2,028,798 | 1/1936 | Murch | 220/62.12 |
| 2,413,093 | 12/1946 | Warth et al. | 220/62.12 |
| 4,181,239 | 1/1980 | Heiremans et al. | 220/62.12 |
| 4,199,622 | 4/1980 | Kokumai et al. | 220/62.12 |
| 5,060,818 | 10/1991 | Doi et al. | 220/62.12 |

*Primary Examiner*—Paul T. Sewell
*Assistant Examiner*—Troy Arnold
*Attorney, Agent, or Firm*—Leydig, Voit & Mayer

[57] ABSTRACT

A sealed metal container adapted for use with candles. The container is coated with a layer of sealing compound so that the side and bottom seams of the container do not leak flowable material. The sealing compound contains a mixture of synthetic wax with sufficient adhesive so that the compound bonds to the surface of the container. Appropriate ratios of synthetic wax and adhesive material are mixed together so that the sealing compound has sufficient flexibility. A method for forming a sealed metal container is also provided in which the sealing compound is melted, pressurized, and sprayed through a nozzle toward the interior surface of the container. The container may be preheated and rotated during spraying to ensure complete coverage.

19 Claims, 3 Drawing Sheets

Fig. 2
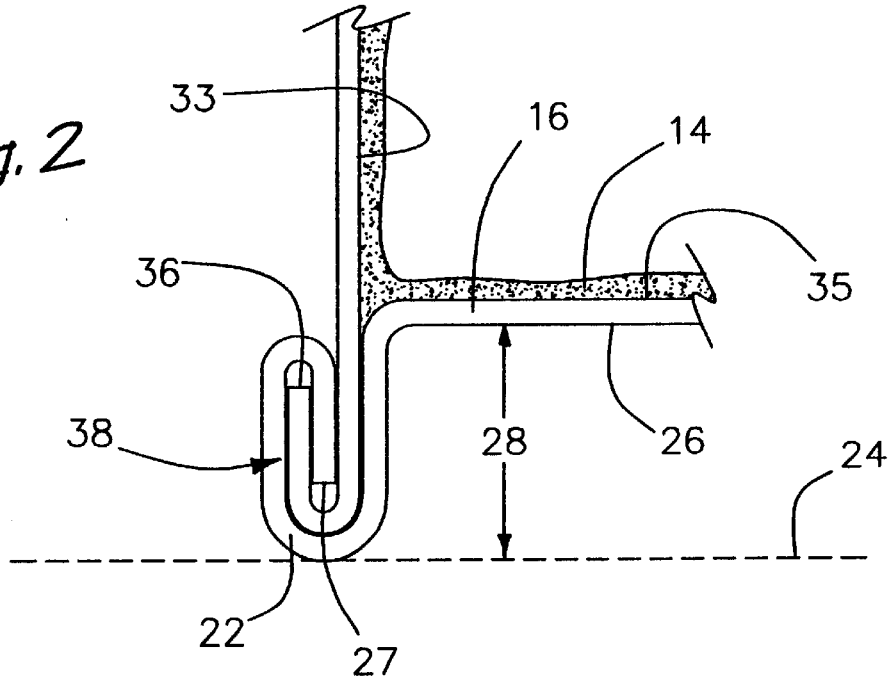
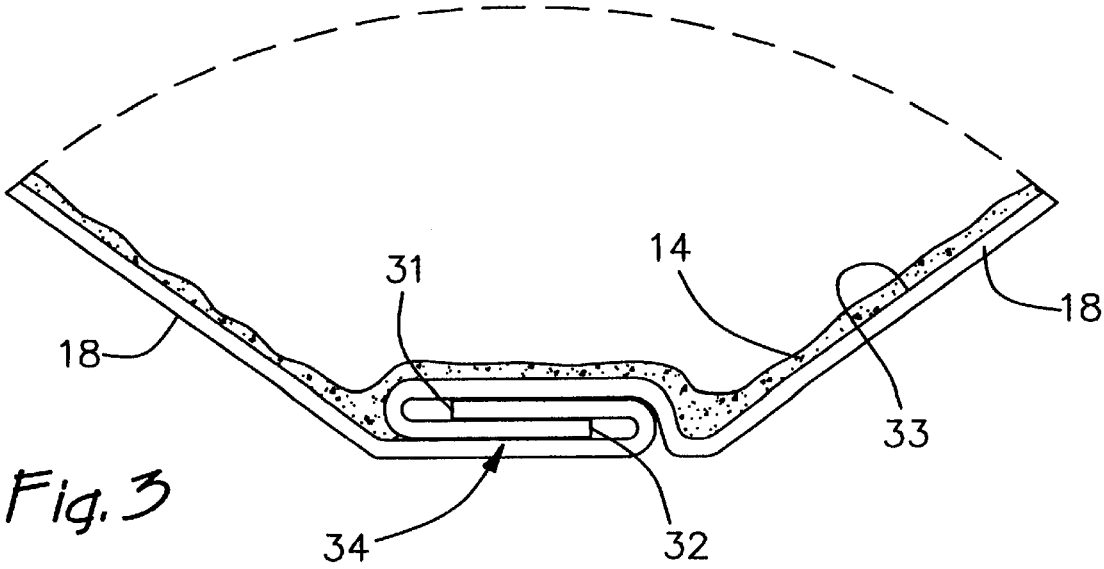
Fig. 3

SEALED METAL CONTAINER

FIELD OF THE INVENTION

The present invention generally relates to containers and, more particularly relates to sealed metal containers and methods for forming the same.

BACKGROUND OF THE INVENTION

A wide variety of products are packaged in metal containers. Metal containers are desirable because they are durable and provide a distinctive appearance. Metal containers further can be formed in various shapes and sizes, and decorated with artwork. As a result, metal containers are often used to hold consumer products.

It is important that a metal container adequately retain the product it holds. Many products have a low viscosity, and therefore flow easily through cracks or seams in packaging. For example, products such as lotions, creams, and wax candles are heated during manufacture to obtain a flowable material which is processed and packaged more easily. Furthermore, products such as candles experience elevated temperatures when used for their intended purpose by the consumer, and therefore again create a flowable material. Metal containers used to hold those products must therefore be capable of retaining material having low viscosity.

Previously, glass jars and drawn metal containers have been used to hold easily flowable materials. Those conventional containers are typically formed as single, unitary pieces so that no seams are formed through which the material may leak. Production of these previous containers in varied shapes and sizes requires extensive machine retooling and therefore is overly time consuming and expensive. Furthermore, it is difficult to improve the appearance of these containers with artwork. Relatively deep drawn metal containers, for example, require artwork to be applied to a flat blank in distorted form so that, after the container is drawn into shape, the artwork is bent into the proper visual appearance. Layout and application of distorted artwork is, however, overly difficult and expensive.

Metal containers formed from multiple pieces are known which are less expensive to make in different shapes and sizes and easier to decorate. For example, a standard three-piece metal container has a base and side wall joined together to form the container, and a removable cover. The side wall is formed from a flat strip of metal that is then bent or rolled into a cylinder, square, or other shape, either regular or irregular. The ends of the side wall are joined to complete the shape. The base is generally flat and is formed to fit on a bottom edge of the side wall. Finally, the cover is a separate piece that is sized to removably fit over the top edge of the side wall.

Unfortunately, multiple piece metal containers create an increased risk of product leakage. From the above, it will be evident that a number of seams are formed between the different components of the three-piece metal container. A seam is formed at the side wall along the vertical height of the container where the opposite ends of the metal strip are joined. In addition, a seam is formed around the entire periphery of the side wall where it joins the base. As a result, materials having low viscosity may leak through the seams of the container.

Previous candle containers have employed various approaches to prevent leakage through container seams. Some containers, for example, have carefully formed seams which are tightly folded. The tight seams, however, are difficult to form and do not reliably prevent leakage. Other containers have used volatile or hazardous materials (such as methyl ethyl ketone(MEK)-based materials) to seal the container seams, and therefore pose a threat to the environment. Furthermore, these materials are typically applied to the container by hand (or "hand-doped") and therefore require expensive manual labor.

SUMMARY OF THE INVENTION

In light of the above, a general aim of the present invention is to provide a seamed metal container which is more reliably sealed with a non-hazardous sealing compound to thereby adapt the container for use with relatively low viscous materials.

In that regard, it is an object of the present invention to provide a seamed metal container which is reliably sealed for use in applications involving elevated temperatures.

A related object of the present invention is to provide a sealed metal container adapted for use with candles which minimizes scorching of the surface on which the container is placed.

It is also an object of the present invention to provide an automated method for sealing a seamed metal container so that it retains flowable materials.

In that regard, it is an object of the present invention to provide an automated method for sealing a seamed metal container which reliably coats the seams of the container.

In light of the above, the present invention provides a seamed metal container having an interior surface coated with a non-hazardous sealing compound. The sealing compound forms a barrier which prevents leakage of flowable, low viscous material through the seams. More particularly, the sealing compound comprises a mixture of synthetic wax with a sufficient amount of adhesive so that the mixture bonds to the interior surface of the container and seals the seams.

It is also a feature of the present invention to provide a support ridge around the base of the metal container which spaces the base from the surface on which the container is placed. The support ridge is formed about the periphery of the base so that, when the container is placed on a surface, only the ridge is in contact with that surface. As a result, when the container holds a material at an elevated temperature, such as a burning candle, a majority of the base is spaced from the surface to create an insulating pocket of air which reduces scorching of the surface by the base.

The present invention further provides a method for reliably sealing a seamed metal container which is automated and therefore reduces labor costs. The method requires the sealing compound to be heated, pressurized, and sprayed through a nozzle. The nozzle is inserted inside an uncoated container and moves along the length of the container as it sprays to coat an interior surface.

These and other objects, advantages, and features of the invention will become more apparent from the following detailed description when taken in conjunction with the accompanying drawings.

BRIEF DESCRIPTION OF THE DRAWINGS

FIG. 2 is a cross-sectional side view of the metal container taken along line 2—2 of FIG. 1.

FIG. 3 is a cross-sectional side view of the metal container taken along line 3—3 of FIG. 1.

Figure 1:
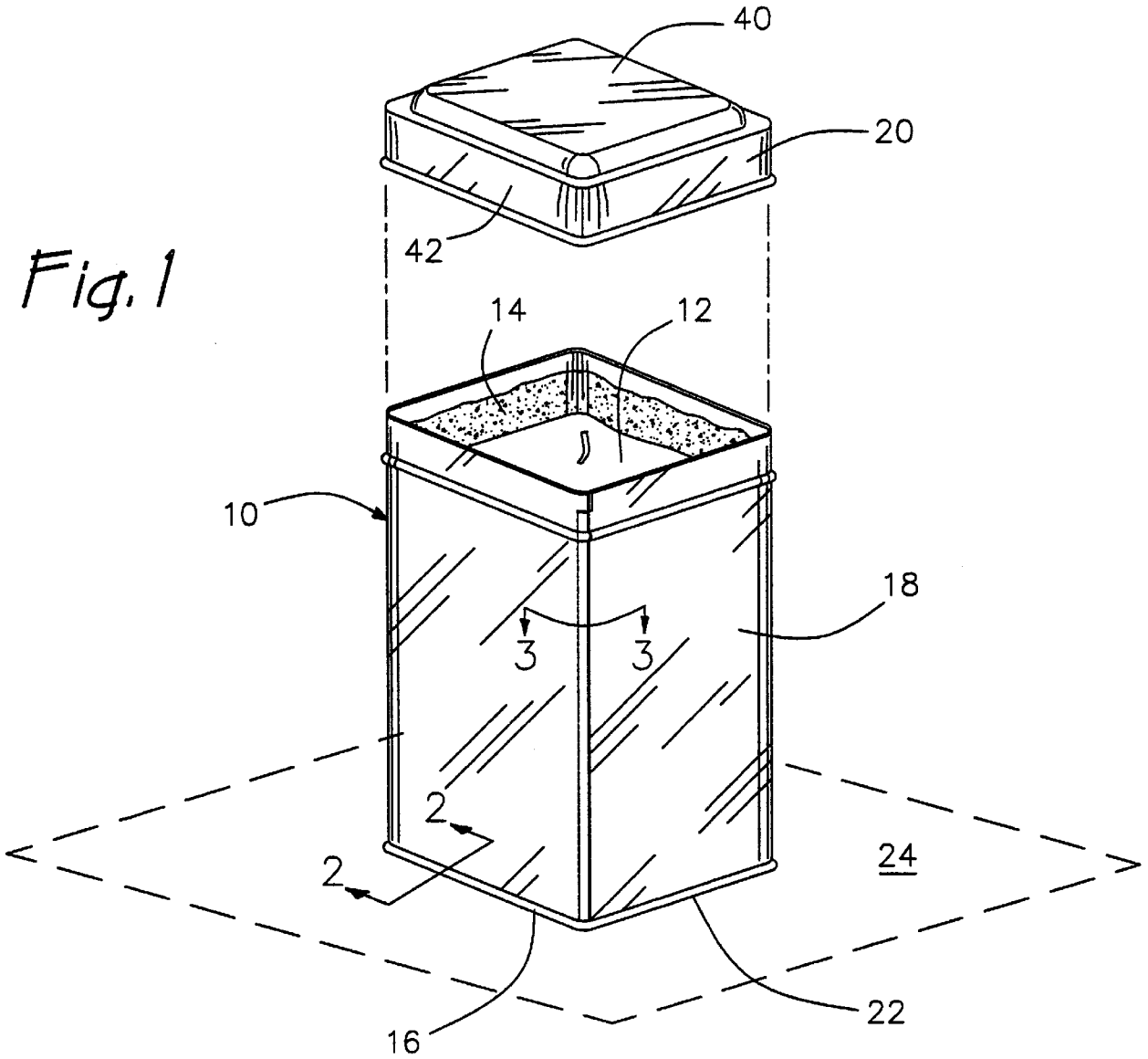
FIG. 1 is a perspective view of a seamed metal container constructed in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration, the invention is shown in FIG. 1 as embodied in a sealed metal container 10 adapted to hold a product such as a candle 12. The interior of the container 10 is coated with a sealing compound 14 which prevents flowable material, such as melted candle wax, from leaking from the container. While the present invention has been illustrated as holding a candle, it will be appreciated that the sealed metal container 12 is capable of holding a wide variety of products, including liquids having a relatively low viscosity. The sealing compound 14 comprises a synthetic wax and an adhesive, as will be described below.

Referring to the container 10 in greater detail, it will be seen that the container generally comprises a base 16, a side wall 18, and a cover 20. As best shown in FIG. 2, the base 16 is formed with a depending ridge 22 extending about a periphery of the base 16. The ridge 22 spaces the bottom face 26 of the base 16 from a support surface 24 on which the container is placed, such as a table. The ridge 22 therefore creates an insulation space 28 between the bottom face 26 of the container and the support surface 24. As a result, only the ridge is in contact with the support surface 24, thereby reducing the area on the support surface which may be scorched when the container 10 is at an elevated temperature.

The side wall 18 comprises a single strip of relatively thin sheet metal which is formed into a shape corresponding to that of the base 16. As best shown in FIG. 3, the side edges 31, 32 of the side wall 18 engage one another to complete the shape of the container 10. The side wall 18 has an inside face 33 which meets the top face 35 of the base to define an interior container surface. The side edges 31, 32 of the side wall 18 are folded over one another to form a side seam 34. A bottom edge 36 of the side wall 18 is folded with an outside edge 27 of the base 16 to form a bottom seam 38 around the entire perimeter of the container 10. In the illustrated embodiment, the side wall 18 is formed to have a generally square shape, however rectangular, circular, or other shapes (both regular and irregular) may also be formed.

The cover 20 is provided for closing the top of the container 10. As shown in FIG. 1, the cover 20 has a flat portion 40 with a depending wall 42. The shape of the wall 42 corresponds to that of the side wall 18. The wall 42 is sized so that it may be installed over a top portion of the side wall 18 and held in place in a press-fit manner. The cover 20 may be removed by pulling up on the cover until the wall 42 disengages the side wall 18.

In accordance with certain aspects of the present invention, the interior surface of the container 10 is coated with the sealing compound 14 to prevent flowable material from leaking through the side and bottom seams 34, 38. As best shown in FIGS. 2 and 3, a layer of sealing compound 14 bonds with the interior surface of the container 10, which includes the inside face 33 of the side wall 18 and the top face 35 of the base 16. The sealing compound 14 prevents flow of material through the seams 34, 38.

In accordance with the present invention, the sealing compound 14 must be sufficiently hard to form a substantially impermeable layer but flexible enough to minimize cracking. As noted above, the container 10 is preferably made of relatively thin sheet metal and therefore is somewhat flexible. The sealing compound 14 must therefore bond with the interior surface and withstand deflections without cracking. A testing protocol for measuring flexibility is provided under ASTM D 2794, incorporated herein by reference. ASTM D 2794 provides a standard test method for resistance of organic coatings to the effects of rapid deformation. Under the method, organic coatings are applied to a thin metal panel. A weight is then dropped a known distance to strike the metal panel, thereby deforming the coating. The distance the weight drops is increased until failure, which takes the form of cracking. According to this method, it has been found that a preferable range of flexibility for the sealing compound 14 is approximately 10 and 20 inch-pounds, and most preferably about 12 inch-pounds.

A protocol for testing hardness is provided under ASTM D 1321-95, incorporated herein by reference. ASTM D 1321-95 provides a standard test method for needle penetration of petroleum waxes. A test sample is heated to a test temperature and a needle is inserted into the sample at a given load for a given period of time. Hardness is measured by the amount of needle penetration into the sample. Using this test, it has been found that a suitable range of hardness for the sealing compound is between 0.01 and 0.3 millimeters when using a 100 gram load on the needle inserted for 5 seconds into the sealing compound heated to 25° C. (0.01–0.3 mm for 100 g/5 secs/25° C.).

The sealing compound 14 is relatively inert so that it does not react with the material stored in the container or heat generated during manufacture or use of the product. The sealing compound 14 further contains minimal volatile organic compounds and therefore does not pose a threat to the environment. Furthermore, the sealing compound 14 is spread relatively easily and evenly over the interior surface of the container 10. Accordingly, the sealing compound preferably has a viscosity of between 1.0 to 200 centipoise (cP), and most preferably 150 cP, on a Brookfield Thermosel at 190° C., to ensure complete coverage.

In the preferred embodiment, the sealing compound 14 is specifically adapted for use with products which are heated during manufacture or generate heat during use. For example, candle wax is typically heated to approximately 70° C. during manufacture so that it may easily be poured into containers. When the candle is subsequently burned, the wax melts at approximately 50–80° C. The melting point of the sealing compound 14 is therefore greater than at least 80° C. and is preferably no less than approximately 102° C. for applications involving heat.

It has been found that a mixture of synthetic wax and adhesive material creates a sealing compound having the above-identified characteristics. The sealing compound may generally be identified as a hydrocarbon hot melt spray compound comprising a mixture of a polyethylene as the synthetic wax and an alkylated cycloaliphatic hydrocarbon as the adhesive. In the most preferred embodiment, the synthetic wax is a polyethylene such as that marketed by Eastman Chemical Company of Kingsport, Tennessee under the trade name "EPOLENE N-14", however similar products (such as "EPOLENE N-10", "EPOLENE N-21", and "EPOLENE N-20") or other known substitutes may also be used. The adhesive is preferably an alkylated cycloaliphatic hydrocarbon such as that marketed by Eastman under the trade name "EASTOTAC RESIN H-100R", although similar products (such as "EASTOTAC RESIN H-100E) or other known substitutes may also be used.

Proper proportions of synthetic wax and adhesive are used so that the sealing compound adheres to the container 10 and displays the desired characteristics noted above. We have determined that a mixture, by weight, of approximately 10–90% polyethylene and a corresponding 90–10% of alkylated cycloaliphatic hydrocarbon forms a hydrocarbon hot melt spray sealing compound which adequately bonds to the interior surface and seals the seams of the container 10. In the most preferred embodiment, the sealing compound comprises 50% synthetic wax and 50% adhesive. Significantly, the wax and adhesive mixture contains minimal volatile organic compounds and therefore does not pose a threat to the environment.

The present invention also provides an automated method for sealing a three-piece container 10 with sealing compound. The method comprises heating and pressurizing the sealing compound so that it is sufficiently flowable for discharge through a nozzle 50. The preferred hydrocarbon hot melt compound described above is heated to a temperature of approximately 102–190° C. to melt the sealing compound. The compound is then pressurized to approximately 1000 psi and pumped through a nozzle 50 toward the interior surface of the container 10. As noted above, the compound preferably has a viscosity of roughly 1.0–200 cP on a Brookfield Thermosel at 190° C. The relatively low viscosity of the sealing compound 14 not only allows the compound to be sprayed, but also ensures that the compound will adequately spread to cover the entire interior surface.

Figure 5:
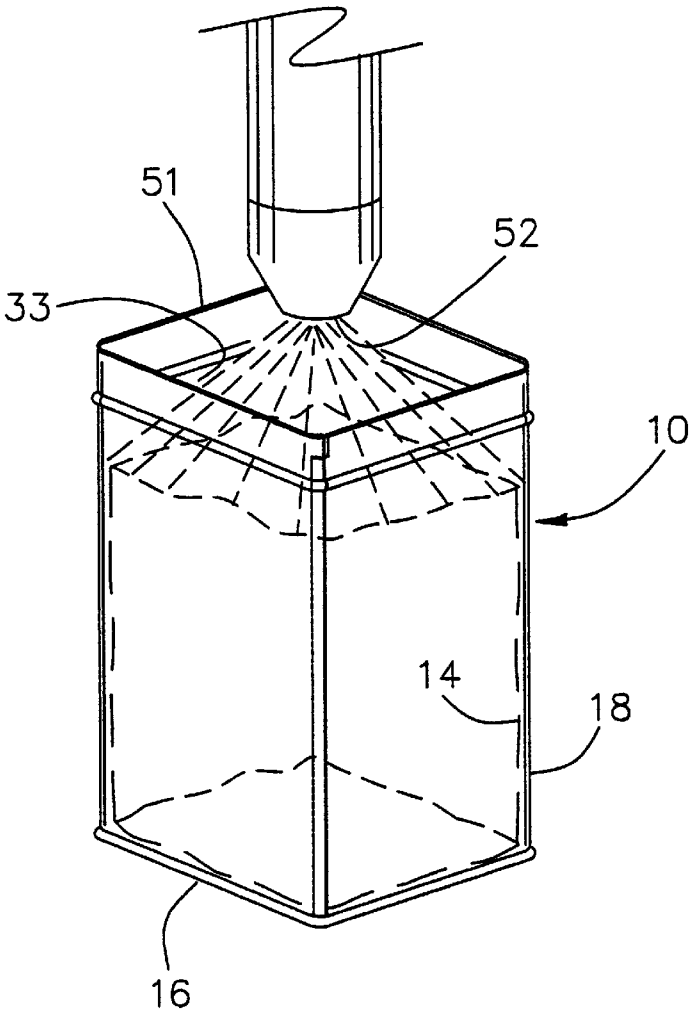
FIG. 5 is a partially schematic representation similar to FIG. 4 showing the nozzle positioned near the top of the container.
Figure 4:
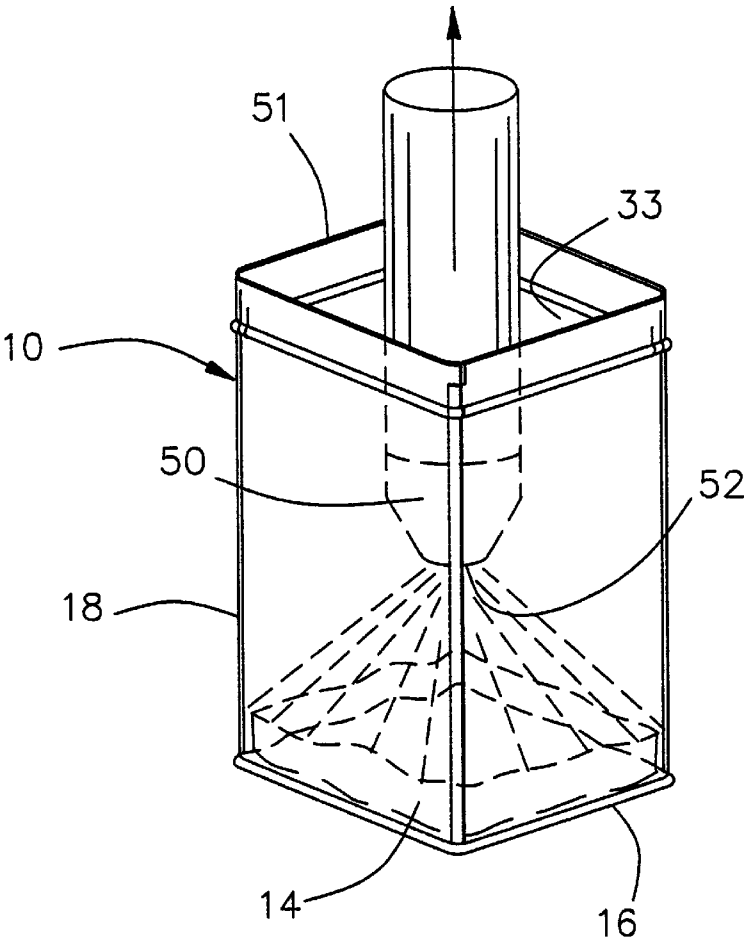
FIG. 4 is a partial schematic representation of the equipment used to spray a sealing compound over the interior of the container showing a nozzle positioned near the base of the container.

To apply sealing compound to an uncoated container, the nozzle 50 is inserted inside the container near the base 16, as shown in FIG. 4. Sealing compound 14 is pumped through the nozzle 50 and directed toward the interior surface of the container 10. The nozzle continues to spray sealing compound as it is actuated toward the top 51 of the container 10 so that the entire interior surface is covered (FIG. 5). The nozzle 50 has a round orifice 52 sized to coat the interior surface with a sufficient thickness of sealing material. For example, as shown in FIGS. 4 and 5, the side wall 18 of container 10 has a generally square shape, and therefore the nozzle orifice 52 must be sized to reach the corners of the container 10. It has been found that a nozzle orifice diameter of approximately 0.03–0.07" is sufficient to cover distances up to 3 inches from the center of the nozzle.

The sealing compound 14 must also be applied in the proper thickness. While the hydrocarbon hot melt spray compound must be applied sufficiently thick to completely cover the interior surface of the container, the sealing compound loses some of its flexibility and tends to crack and pull away from the container 10 if it is applied too thick. Accordingly, it has been found that the sealing compound should be applied in a thickness of between about 0.03–0.08" to avoid cracking. In the preferred embodiment, the sealing compound has a thickness of approximately 0.05".

During the sealing operation, the container 10 may be heated to ensure that the interior surface is completely coated with sealing compound 14. For larger container sizes in particular, it has been found that the melted sealing compound cools as it travels from the nozzle to the interior surface. The cooling increases the viscosity of the sealing compound, thereby decreasing the amount of interior surface area covered. To help ensure maximum coverage, the container 10 is heated to maintain the temperature, and therefore the viscosity, of the sealing compound 14. In this embodiment, the container 10 is preferably heated to approximately 125° C.

To further improve coverage of the interior surface, the container 10 is rotated during spraying. As noted above, the sealing compound has a preferred viscosity which allows the compound to spread once it contacts the container 10. In a preferred embodiment, the container 10 is rotated during spraying to increase the amount of spread and therefore more reliably coat the entire interior surface. While any amount of rotation is beneficial, the container 10 is preferably rotated at speeds of at least around 100 rpm to provide more consistent coverage. Rotation of the container 10 ensures that the sealing compound spreads before it cools.

From the forgoing, it will be appreciated that the present invention brings to the art a sealed metal container which reliably retains relatively low viscous materials. The interior surface of the container is coated with a sealing compound which retains relatively lower viscosity materials. The sealing compound comprises a mixture of synthetic wax with sufficient adhesive so that the compound bonds to the surface of the container and seals the seams to prevent material from leaking out of the container. Furthermore, the sealing compound is non-hazardous. The present invention also provides an automated method for sealing a seamed metal container with sealing compound. The method comprises heating and pressurizing the sealing compound so that it may be sprayed through a nozzle. The nozzle is placed inside the uncoated container and discharges as it travels the height of the container to cover the interior surface. The container may be preheated and rotated during spraying to more reliably cover the entire interior surface.

What is claimed is:

1. A sealed metal container for holding a relatively low viscous material, the container comprising:

a base having top and bottom faces, a formed side wall member engaging the top face of the base to form a bottom seam, opposing ends of the side wall member engaging one another to form a side seam, the side wall member and top face defining an inside surface of the container, and a sealing compound including a mixture of synthetic wax and adhesive, the compound having a sufficient fraction of adhesive to allow bonding of the compound to the inside surface of the container, the sealing compound when bonded having a flexibility of approximately 10 to 20 inch-pounds, a hardness of approximately 0.01 to 0.3 mm for 100 g/5 secs/25° C., and a melting point of at least 80° C.

2. The sealed container of claim 1 in which the melting point of the sealing compound is at least 102° C.

3. The sealed container of claim 1 in which the flexibility of the sealing compound is approximately 12 inch-pounds.

4. The sealed container of claim 1 in which the sealing compound has a viscosity of approximately 1.0 to 200 cP on a Brookfield Thermosel at 190° C.

5. The sealed container of claim 1 in which the sealing compound is applied to the container with a thickness of between approximately 0.03 and 0.08 inches.

6. The sealed container of claim 1 in which the sealing compound is applied to the container with a thickness of approximately 0.05 inches.

7. The sealed container of claim 1 in which the synthetic wax is a polyethylene.

8. The sealed container of claim 7 in which the adhesive is an alkylated cycloaliphatic hydrocarbon.

9. The sealed container of claim 1 in which the sealing compound comprises between approximately 10–90% synthetic wax and between approximately 10–90% adhesive.

10. The sealed container of claim 1 in which the sealing compound comprises approximately 50% synthetic wax and approximately 50% adhesive by weight.

11. A method for sealing a seamed metal container for holding a relatively low viscous material, the container including a base having a top face, a formed side wall member attached to the base to form a bottom seal, opposing ends of the side wall member attached to one another, the side wall member and top face defining an inside surface of the container, the method comprising the steps of:

a. mixing a sufficient amount of adhesive with a synthetic wax to form a sealing compound adapted to bond to the inside surface of the container, the sealing compound having a flexibility of approximately 10 to 20 inch-pounds, a hardness of approximately 0.01 to 0.3 mm for 100 g/5 secs/25° C., and a melting point of at least 80° C.;

b. melting the compound at a temperature between approximately 80 to 190° C., c. pressurizing the compound to approximately 1000 psi, and d. spraying the compound through a nozzle while directing the nozzle toward the inside surface of the container to coat the container with a thickness of approximately 0.03 to 0.08 inches.

12. The method of claim 11 in which the melting point of the sealing compound is at least 102° C., and the melting step is performed at a temperature of between approximately 102° C. to 190° C.

13. The method of claim 11 in which the nozzle has an orifice with a diameter of approximately 0.03 to 0.07 inches.

14. The method of claim 11 further comprising the step of preheating the container to at least 125° C. before step d.

15. The method of claim 11 in which the container is rotated at between 1 and 100 rpm during step d.

16. The method of claim 11 in which the synthetic wax is a polyethylene.

17. The method of claim 11 in which the adhesive is a alkylated cycloaliphatic hydrocarbon.

18. The method of claim 11 in which the sealing compound has a viscosity between approximately 1–200 cP on a Brookfield Thermosel at 190° C.

19. The method of claim 11 in which the thickness of the sealing compound is approximately 0.05 inches.

* * * * *